US006371827B1

(12) United States Patent
Chou

(10) Patent No.: US 6,371,827 B1
(45) Date of Patent: Apr. 16, 2002

(54) AUTOMATED DOLL WITH A SET OF LIGHT EMITTED CHRISTMAS DECORATIONS

(76) Inventor: I-Hsiung Chou, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/632,240

(22) Filed: Aug. 3, 2000

(51) Int. Cl.[7] ..... A63H 13/00
(52) U.S. Cl. ..... 446/354; 446/219
(58) Field of Search ..... 446/219, 330, 446/352, 353, 354

(56) References Cited

U.S. PATENT DOCUMENTS 4,801,285 A * 1/1989 Yeu ..... 446/353 X
4,875,886 A * 10/1989 Sung ..... 446/354 X
5,121,646 A * 6/1992 Cho ..... 446/354 X
5,176,560 A * 1/1993 Wetherell et al. ..... 446/354 X
5,247,753 A * 9/1993 Yang ..... 446/354 X
5,277,644 A * 1/1994 Osborne et al. ..... 446/219

FOREIGN PATENT DOCUMENTS

GB 2188851 * 10/1987 ..... 446/353

* cited by examiner

*Primary Examiner*—John A. Ricci
(74) *Attorney, Agent, or Firm*—Troxell Law Office PLLC

(57) ABSTRACT

An automated doll with Christmas light bulbs, particularly an automated doll using an axle and a gear mechanism to enlarge the effective space of an upper section inside the doll body. A base and the body are coupled together to accommodate the loading block and the optical fiber. Light-emitting components and a color disk disposed inside the base of the body to attain the effect of bright light emission at the top portion of the automated doll, and to achieve a large angle of rotation for the automated doll.

3 Claims, 8 Drawing Sheets

AUTOMATED DOLL WITH A SET OF LIGHT EMITTED CHRISTMAS DECORATIONS

BACKGROUND OF THE INVENTION

1. Field of the Invention

The present invention relates to an automated doll with light emitting Christmas decorations using an axle and a set of gears to enlarge the effective space at the upper section inside the doll body, and coupling the light-emitting components and a rotational motor with the base of the body together to attain the desired effect.

2. Description of the Prior Art

The structure of conventional automated dolls, as shown in FIG. 1, has at least one light emitting member disposed in end section 1' of the doll, and a motor 4 mounted on the lower portion of a middle disk member 2'. Such motor is coupled with a main transmission axle 50' extending from the middle disk 2' to the interior of a transparent housing 3'. The main transmission axle intersects with three axles 51', 52' and 53'. The other end of each of the three axles intersects with three transmission sub-axles 54', 55' and 56', which undergo back and forth rotation. An external element, such as the hand of the doll, is coupled to the transmission sub-axles 54', 55' and 56', such element moves back and forth with a large angle. However the conventional rotation mechanism for the dolls of this sort occupies too large a space, and has to wait until the assembly is complete before performing tests for defects.

Therefore, in summation of the above description of the prior art, the inventor of the present invention based on years of experience in the related industry conducted extensive research to enhance the structure of the automated doll herein.

SUMMARY OF THE INVENTION

Therefore, the primary objective of the present invention is to provide a rotation mechanism for an automated doll having a set of light emitting Christmas decorations, which allows the doll to move with a larger rotation angle.

To make it easier to understand the performance, the structure, and the innovative features of the present invention, a preferred embodiment is described together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENT

Figure 1:
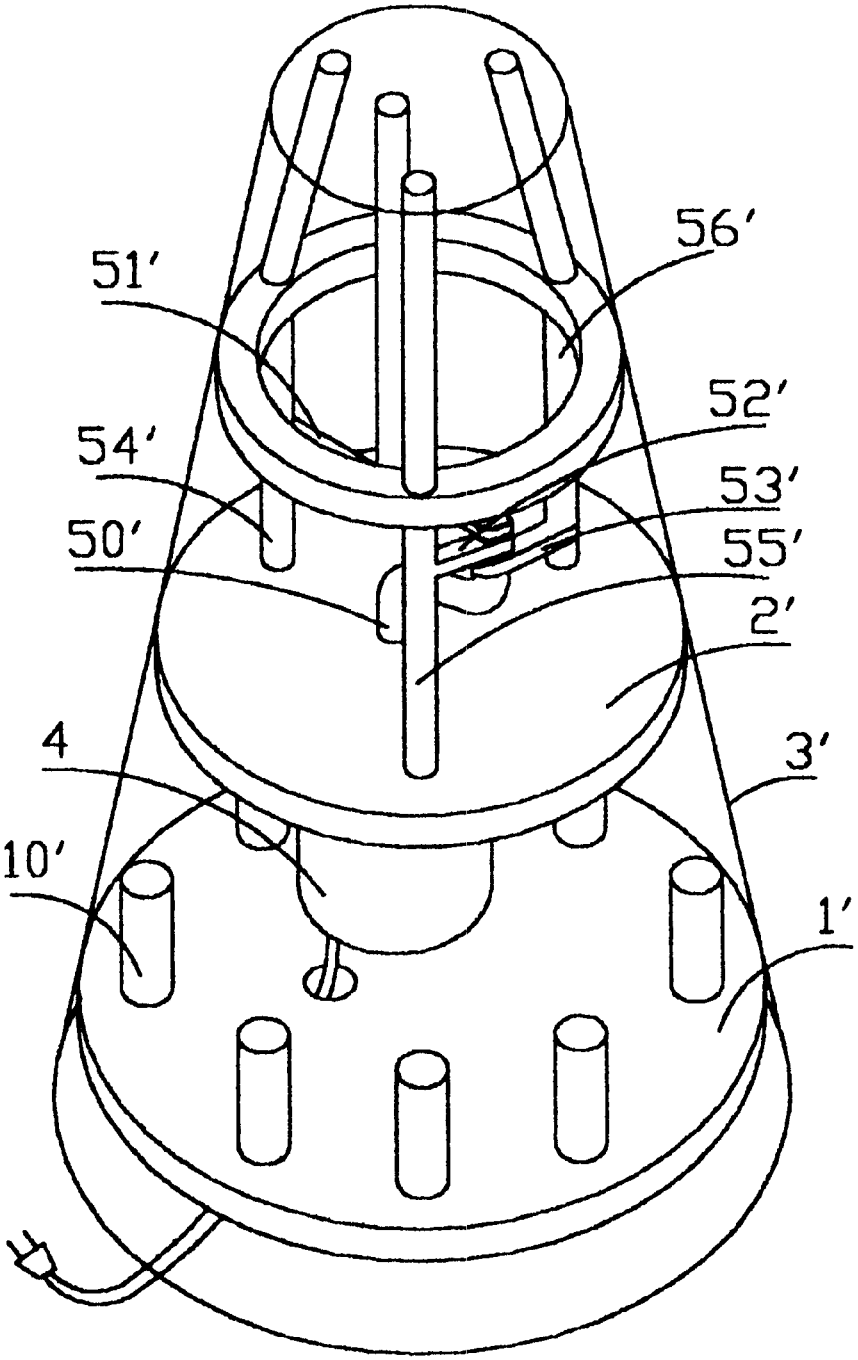
FIG.1 Prior Art
FIG. 1 is a perspective view of the conventional automated doll mechanism.
Figure 2:
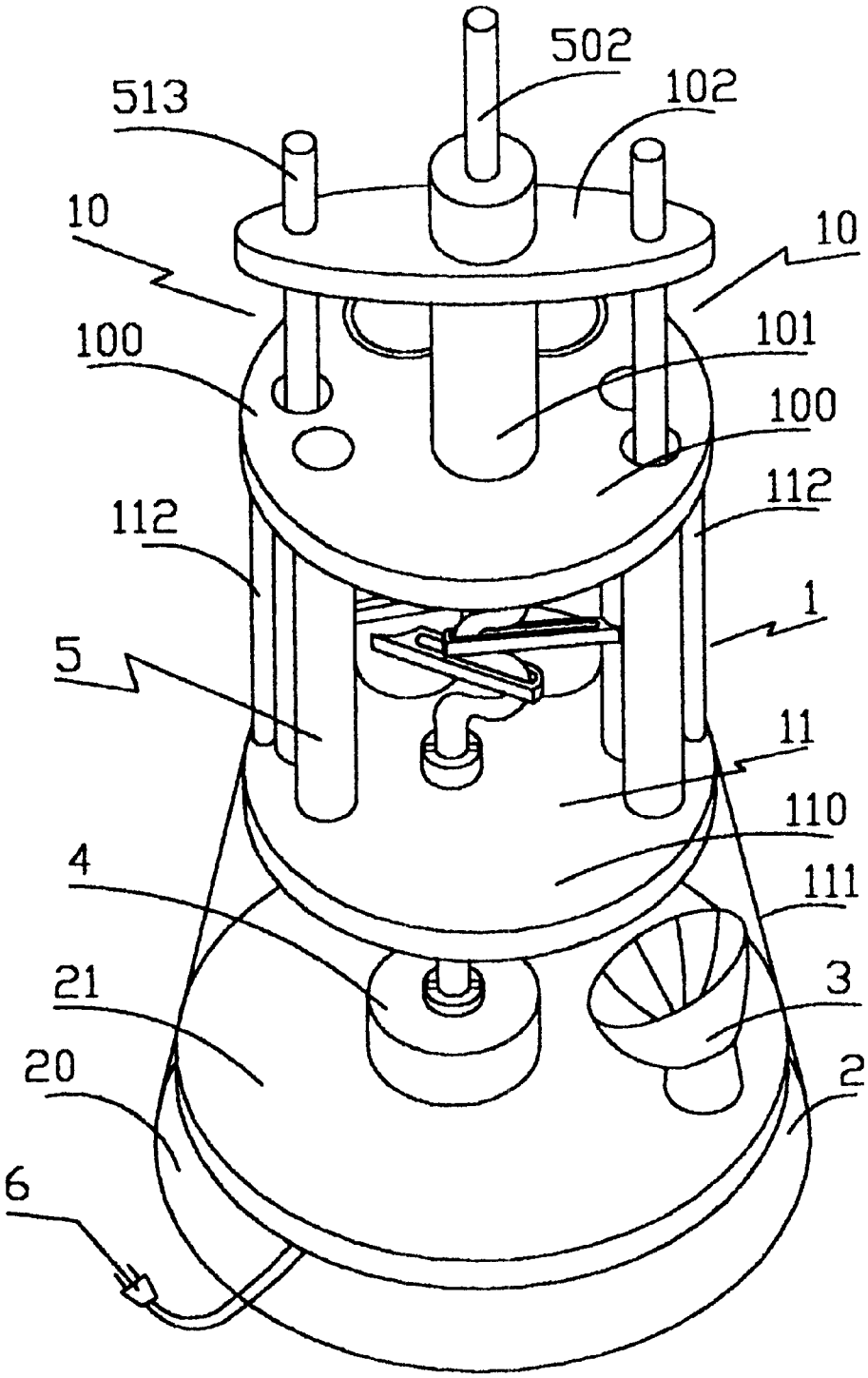
FIG. 2 is a perspective view of the mechanism of the present invention.
Figure 3:
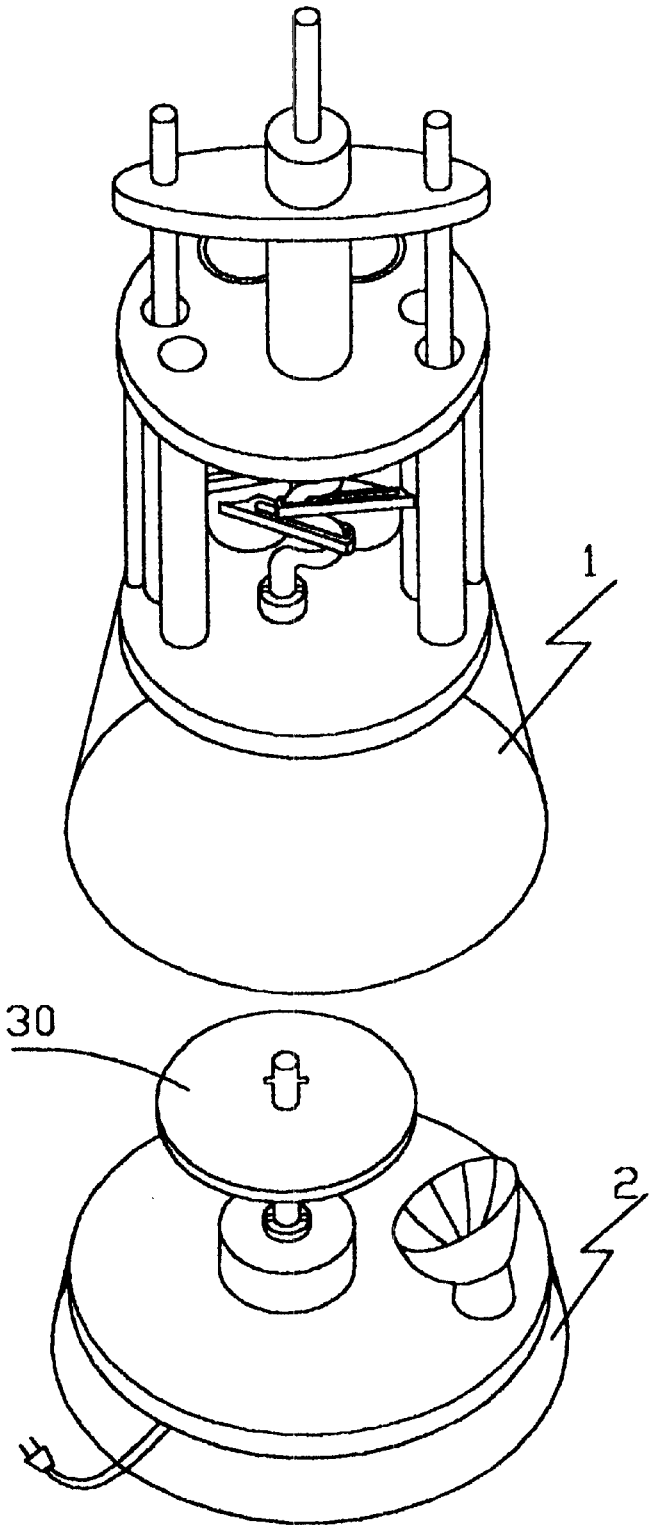
FIG. 3 is a partial, exploded view of the mechanism of the present invention.
Figure 4:
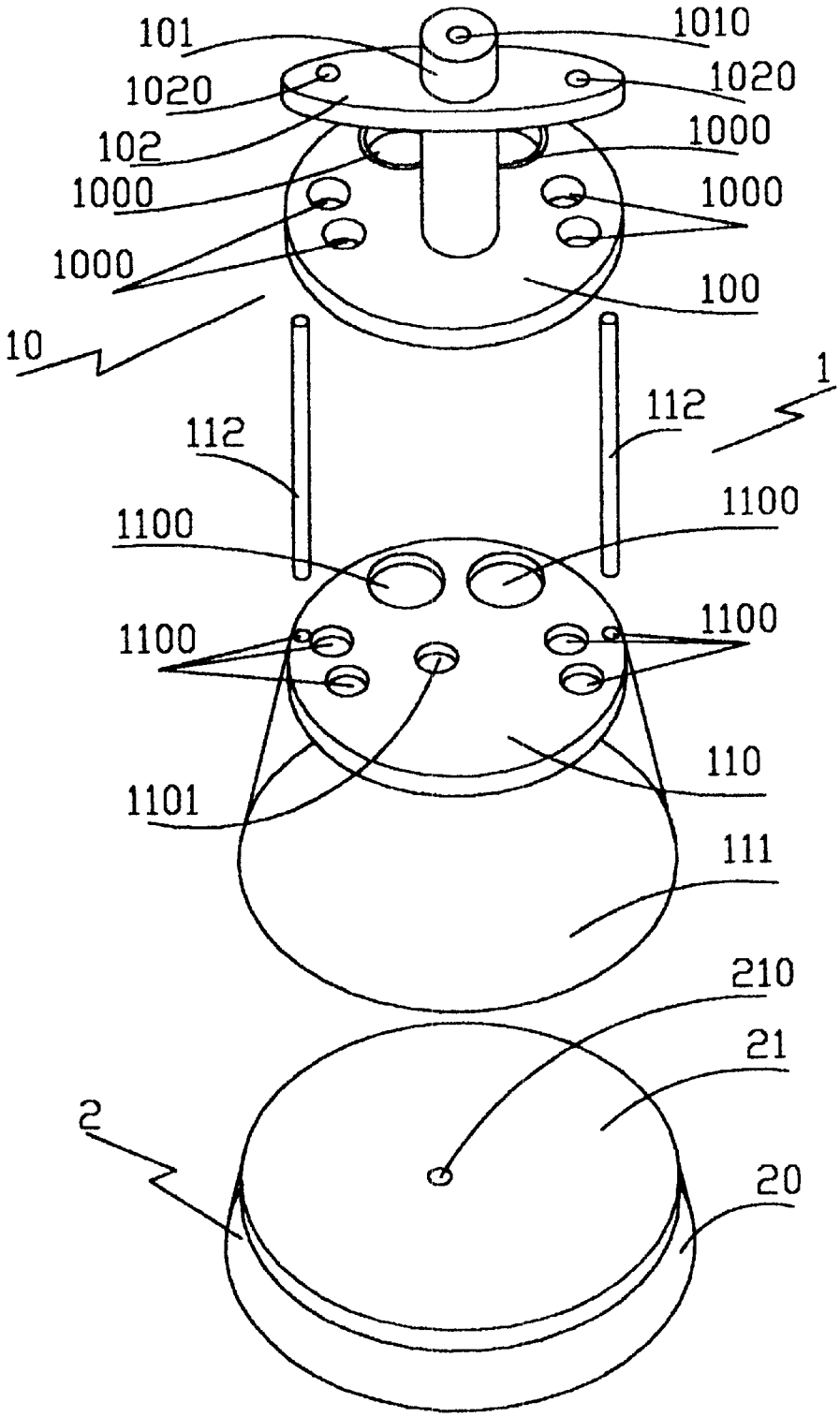
FIG. 4 is a partial, exploded view of the mechanism of the present invention.
Figure 5:
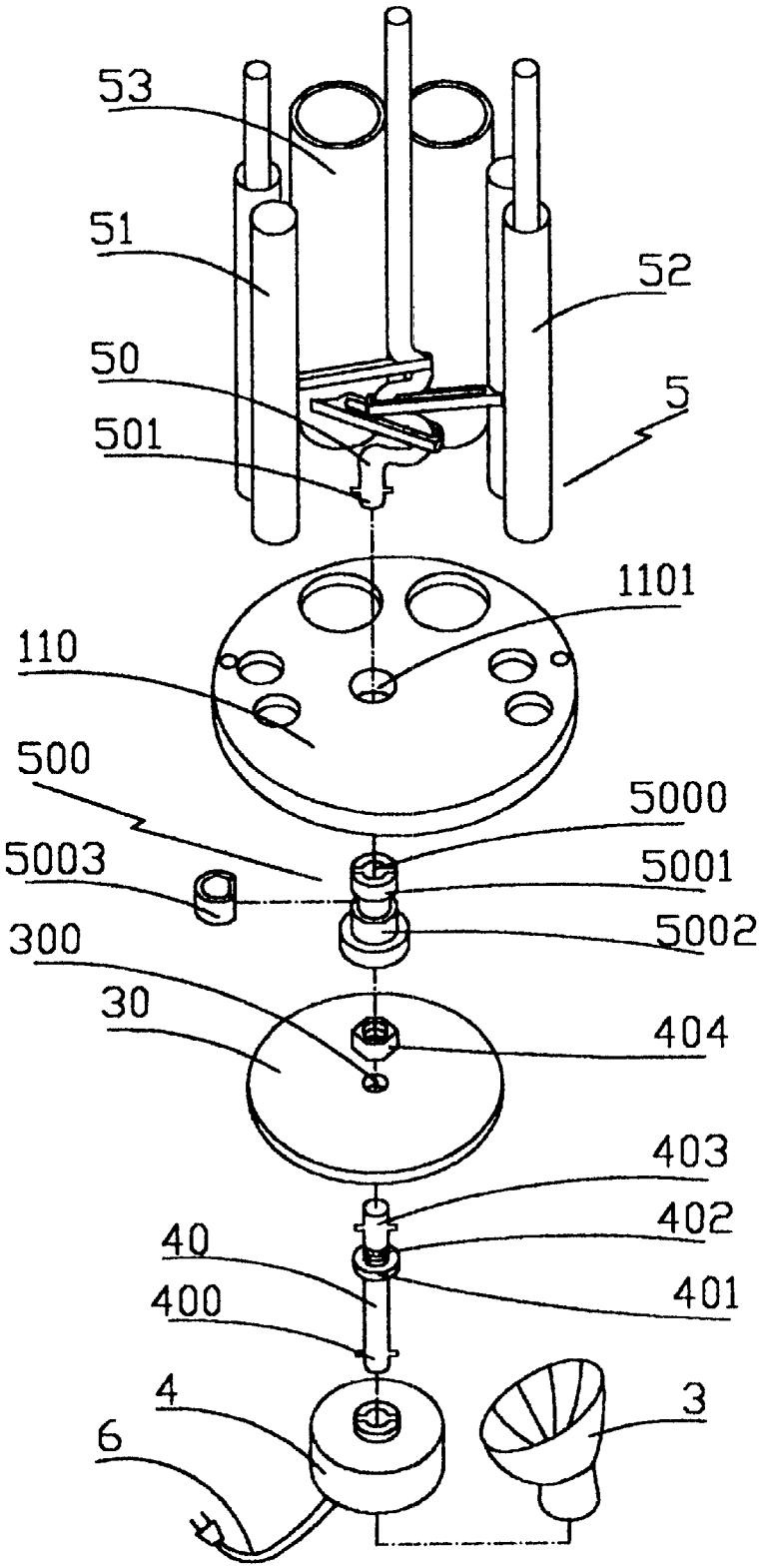
FIG. 5 is a partial, exploded view of the mechanism of the present invention.
Figure 6:
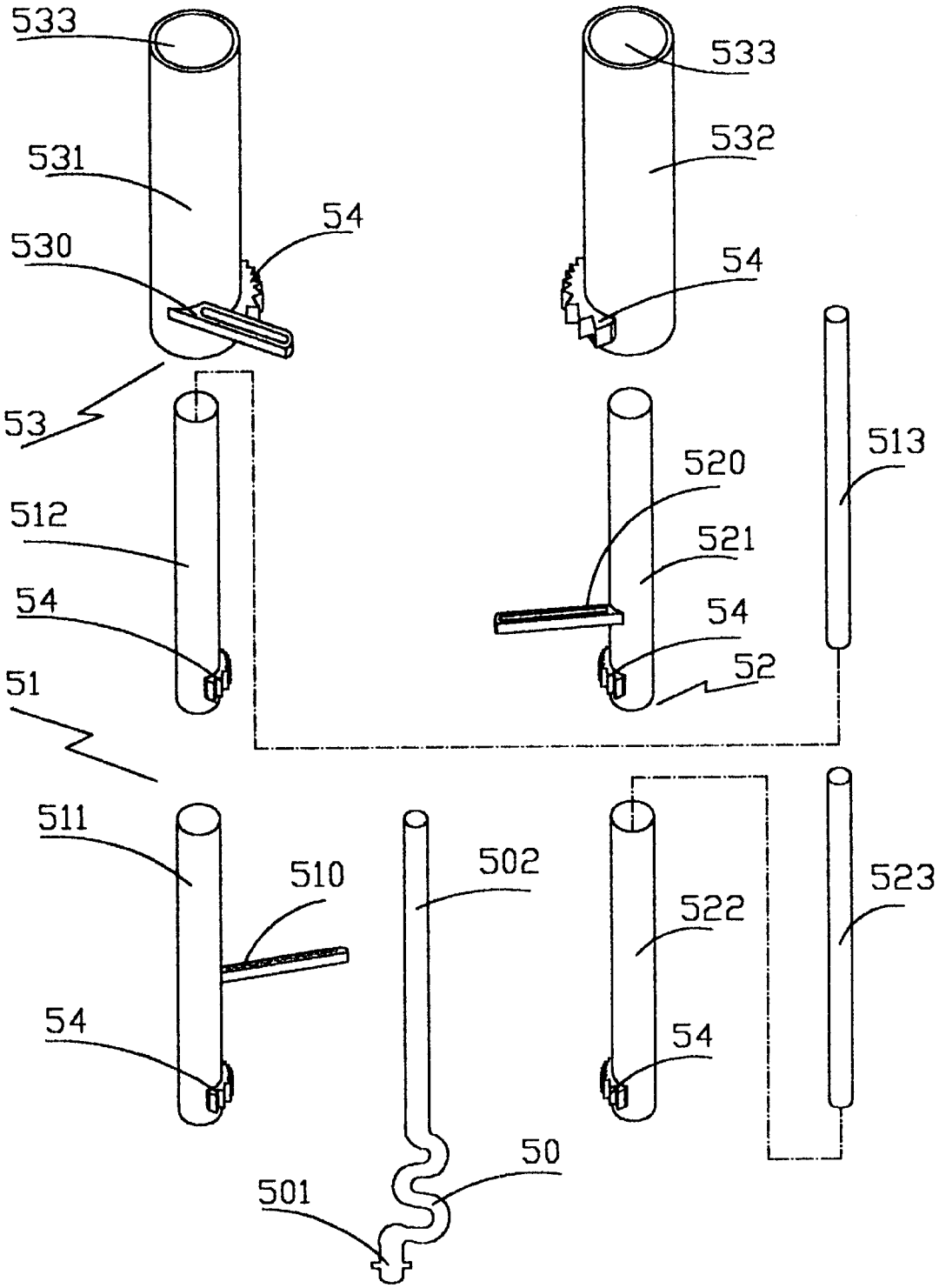
FIG. 6 is a partial, exploded view of the mechanism of the present invention.
Figure 7:
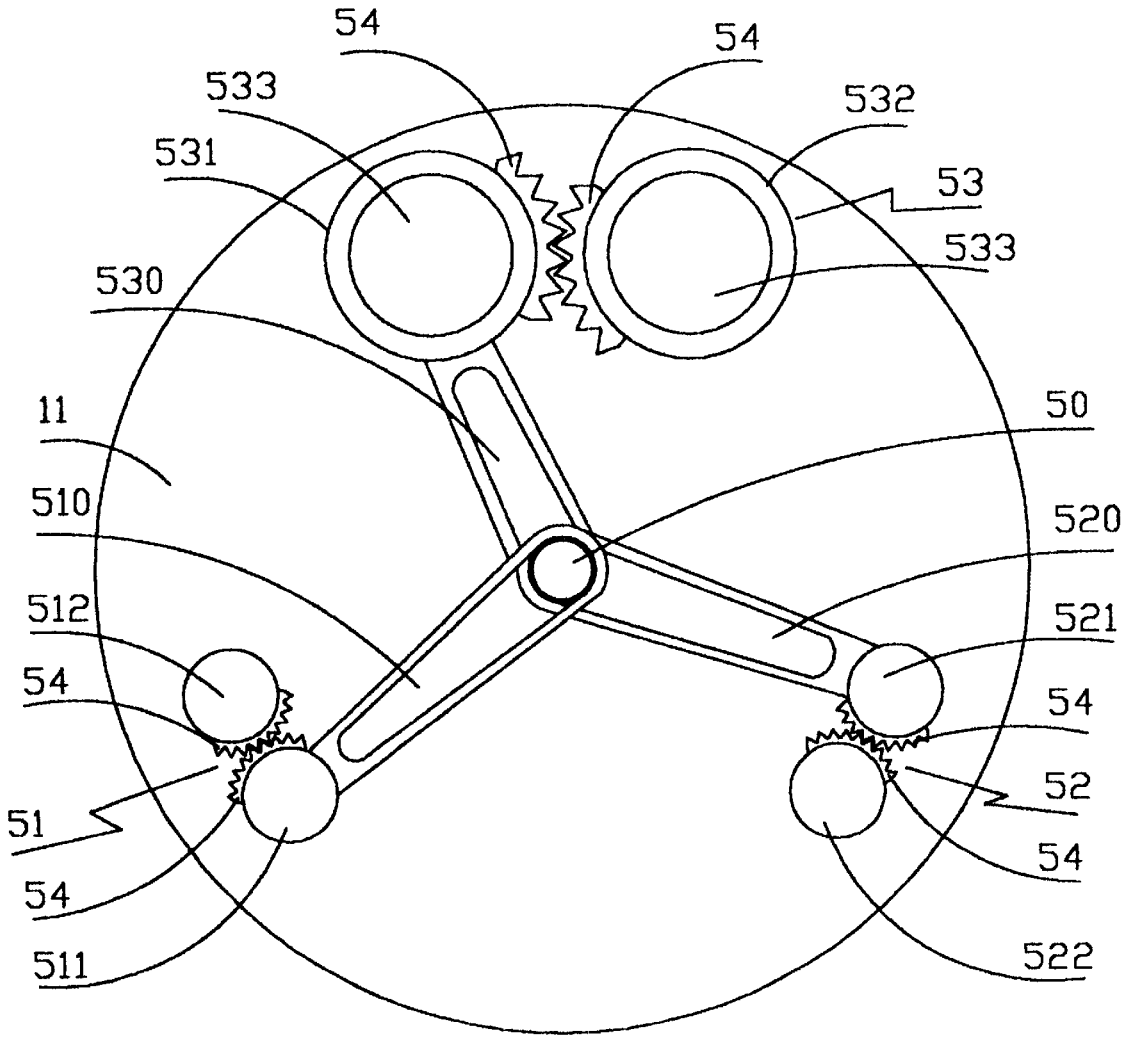
FIG. 7 is a partial top view of the mechanism of the present invention.

Referring to FIGS. 2 and 3, the mechanism of the present invention uses an upper section member 1 to fix the rotation mechanism 5 to the accommodating space inside the upper section member 1. The transparent accommodating body side casing 111 and a base body 2 also define an accommodating space, and such accommodating space has a light emitting element 3 for providing light, and a rotation motor 4 for providing mechanical energy to the rotation mechanism 5. This invention can be manufactured with an upper half section and a lower half section as shown in FIG. 3 to facilitate testing functions and lower the cost.

Referring to FIGS. 2, 4, 5, 6, and 7, the structure of the present invention comprises an upper section member 1, a base member 2, a light emitting element 3, a rotation motor 4, and a rotation mechanism 5.

The upper section of the upper section member 1 is a lid 10 of the upper casing, the lower portion of the upper casing is an upper disk 100 having a periphery with a plurality of holes known as upper disk holes 1000. The upper portion of the upper disk 100 has a post 101, the top end of the post 101 having a hole rim 1010 and a platform disk 102 extending from both directions of the lateral side of the post 101, each of the opposite sides of the disk having a hole 1020. The middle section of the upper section member 1 is an accommodating member 11, between the upper disk 1000 and a lower disk 110, having lower disk holes 1100 and a lower disk central hole 1101. The lower portion of the lower disk 110 has a transparent casing 111, and the upper portion of the lower disk 110 support a plurality of supporting columns 112.

The space below the upper lid 10 of the upper disk 100 and above the accommodating member 11 of the lower disk 110 forms an internal accommodating space with a plurality of supporting columns 112 (for simplicity, two supporting columns are used for the description of this embodiment). The rotational mechanism 5 is mounted in the accommodating space of the upper section member 1 and is fixed by the upper disk hole 1000 and the lower disk hole 1100.

A base body 2 is attached to the lower edge of the upper section member 1, and the side casing 20 is also made of transparent material having a hollow middle and an upper section with a disk body as the base disk 21. The base disk can accommodate the light emitting elements 3 and the rotation motor 4 into the space formed by the edge of the transparent casing 111 of the upper section body, and has hole 210 for the power cord 6 to pass through.

The light emitting element 3 and the rotation motor 4 both are disposed and mounted onto the upper section of the base disk 21 and coupled to the power cord 6 for obtaining electrical power. The rotation motor is coupled to a latching axle head 400 at the lower part of the motor linkage axle 40. The motor transmission axle 40 at the top has a device 401 to press the lower section of the color disk 30. A threaded portion 402 and the upper latching axle head 403 extend upwardly passing through and being mounted to a color disk hole 300 and fixing the motor linkage axle 40 to the color disk 30 by the screw nut 404 and the threaded portion 402. There is a central hole 1101 on the lower disk 110 having a latching member 500, the latching member 500 having an upper surface, a lower surface and a hollow latching hole 5000 for receiving the axle head 501 at the lower section of the main transmission axle 50 and the upper latching axle head 403 of the transmission axle. The upper section 5001 of the latching member protrudes above the upper surface of the lower disk 110, and the lower section 5002 of the latching member 500 just fits into the central hole 1101 at the lower disk and fixes the latching member 500 to the lower disk 110 by the bracket 5003. Such an arrangement combines the upper section member and the base body together, with the latch axle head 403 of motor linkage axle 40 inserted not the latching member 500, and the main transmission axle latching head 501 also just fits into the latching member 500.

The rotational linkage mechanism 5 comprises a main linkage axle 50, a left transmission link 51, a right transmission link 52, a loading block link 53, and a plurality of curved gears 54. The main transmission link 50 is disposed at a central position inside the upper section member 1, the latching axle head 501 at the lower section of the main transmission axle 50 is coupled to the latching member 500 to facilitate the rotation motor 4 to rotate the main linkage axle 50. The main linkage axle 50 is a dual curved member which is different form the old-fashioned main linkage axle 50' having only one curved member. The main transmission axle 50 extends upward to have a main rotational axle 502 which passes through the hole in the post 101 and can move freely in the interior space. The left transmission link 51 has axle 510 connected to the main transmission link 50 and to the left transmission axle 511. The left transmission link 51 also has a left axle 512, engaged with the left transmission axle 511 by gears 54 so that, when the main transmission axle 50 rotates, it moves the left axle 510 in a shifting rotation movement and further rotates the left transmission axle 511 and the left axle 512 in back and forth rotational movement. The left axle 512 extends upward to form a left axle 513 passing through and being mounted to the two-hole edge 1020 of the disk within the space where it can freely move. With a similar principle and structure, and approximately in the position of the three points of the triangle at the space between the upper disk and the lower disk 110 in the upper section of the upper section member 1, there are a right transmission link 52 and a loading block link. The right transmission link has a right transmission axle 522 engaging a right rotational axle 521 by matching curved gears 54. The loading block 53 also has a loading block transmission axle 530 and a loading block rotation axle 531 engaged with loading block axle 532 by curved gears 54. In addition, the loading block transmission axle 530 and the loading block rotational axle 531 respectively has a cup member formed by extending the central space of a volume having a larger area at the bottom as the loading block 533.

Figure 8:
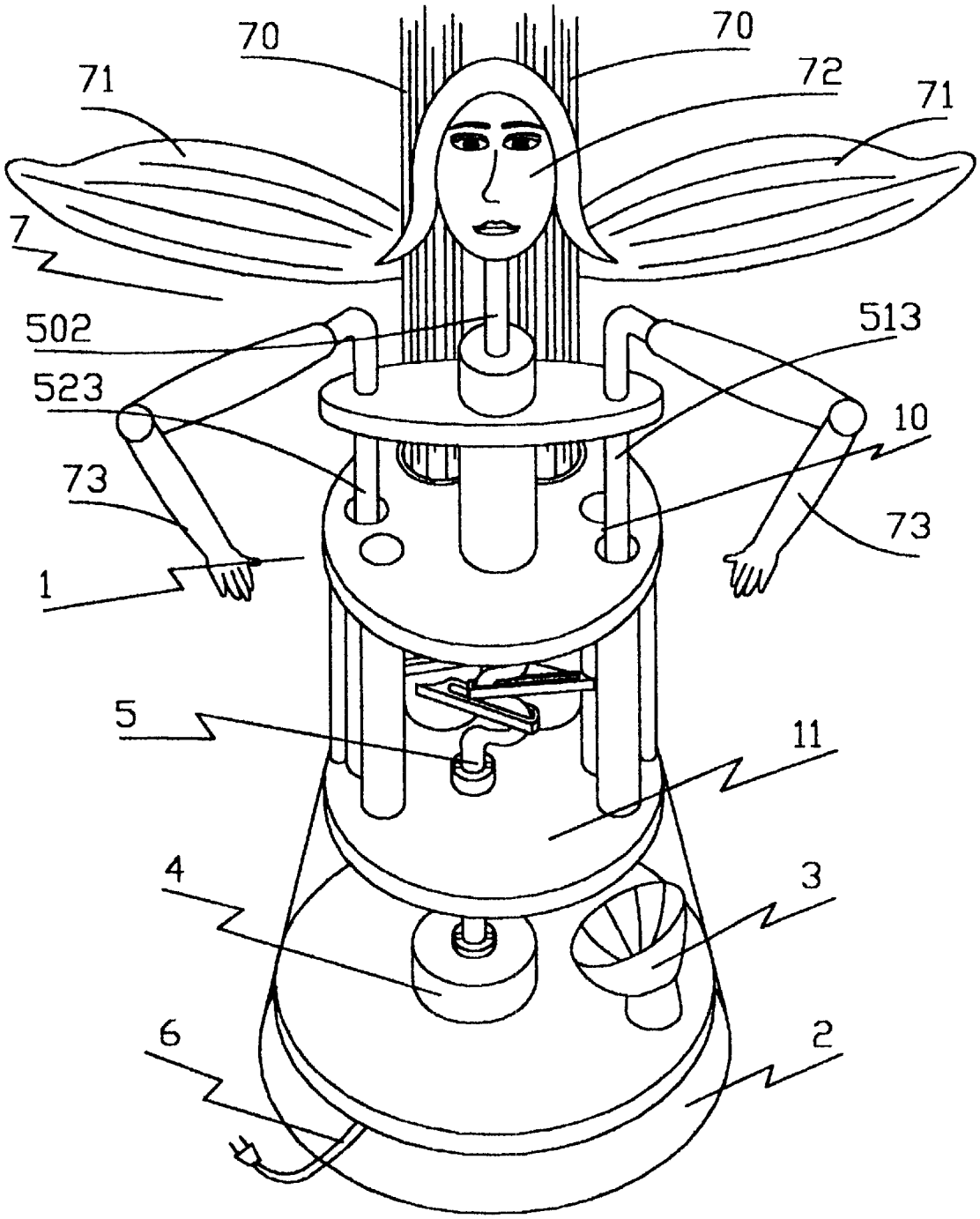
FIG. 8 is a perspective view showing external elements mounted on the mechanism of the present invention.

As shown in FIG. 8, when decorations 7 are added, the optical fibers 70 in the decorations 7 and the wings 71 can be inserted into the loading block 533. By the back and forth rotational movement via the loading block linkage axle 531 and the loading block rotational axle 532, the wings with optical fibers 70 perform the back and forth movement. Furthermore, the main rotation axle 502 is coupled to the external decoration (head) 72. The left rotation axle 513, the right rotation axle 523 and the external decoration (hand) 73 are connected, the left rotation axle 513 and the right rotation axle 523 rotate and will in turn rotate the external decoration (hand) 73 with the same angle of back and forth rotation movement, and make the decorations 7 more attractive. The light emitting element 3 on the base disk 21 of the base body 2 will provide a colorful light via the color disk 30 to illuminate the optical fibers 70 and the wings 71.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An automated doll, light emitting Christmas decoration, composed of a body structure and an external decoration, the body structure comprising: an upper section member, a base member, a light emitting element, a rotation motor, and a rotational linkage mechanism; wherein the upper section member has an upper casing and an upper disk, the upper disk having a plurality of upper disk holes, a post with a top end of the post having a hole rim, and a platform disk extending laterally in opposite directions from the post; the upper section member is an accommodating member having a lower disk, with lower disk holes and a lower disk central hole, a lower portion of the lower disk having a casing, and a plurality of supporting columns extending between the lower disk and the upper disk;

the base member having a base disk, to which is mounted the light emitting element and the rotation motor;

the rotational linkage mechanism comprising: a main linkage axle rotated by the rotation motor, a left transmission link, a right transmission link, a loading block, and a plurality of curved gears; wherein the main linkage axle is disposed in a central position and has an upwardly extending main rotational axle portion; the left transmission link having a left axle connected with the main linkage axle, a lower section of the left transmission link having a first curved gear thereon engaged with a second curved gear on a left transmission axle; a right transmission link having a right axle connected with the main linkage axle, the right transmission link having a third curved gear thereon engaging a fourth curved gear on a right rotational axle; the loading block having a loading block transmission axle connected to the main linkage axle and having a fifth curved gear engaging a sixth curved gear on a loading block rotational axle, the loading block transmission axle and the loading block rotational axle respectively each having a central cup member formed thereon.

2. The automated doll as set forth in claim 1, wherein the main transmission axle comprises a transmission axle having two curved members.

3. The automated doll as set forth in claim 1, further comprising a latching connection disposed at a lower section of the main linkage axle for coupling with the rotation motor.

* * * * *